US005362337A

United States Patent [19]

Kosa

[11] Patent Number: 5,362,337

[45] Date of Patent: Nov. 8, 1994

[54] FREE-MACHINING MARTENSITIC STAINLESS STEEL

[75] Inventor: Theodore Kosa, Reading, Pa.

[73] Assignee: CRS Holdings, Inc., Wilmington, Del.

[21] Appl. No.: 127,341

[22] Filed: Sep. 28, 1993

[51] Int. Cl.[5] ..... C22C 38/20

[52] U.S. Cl. ..... 148/325; 420/60

[58] Field of Search ..... 420/60; 148/325

[56] References Cited

U.S. PATENT DOCUMENTS

| | | | |
|---|---|---|---|
| 1,964,702 | 6/1934 | Summers . | |
| 2,834,330 | 9/1958 | Tanczyn . | |
| 2,850,380 | 9/1958 | Clarke, Jr. | 420/60 |
| 2,897,078 | 7/1959 | Nishikiori . | |
| 3,401,035 | 9/1968 | Moskowitz et al. . | |
| 3,645,722 | 2/1972 | Aulenbach et al. . | |
| 4,326,885 | 4/1982 | Larson et al. . | |
| 4,769,213 | 9/1988 | Haswell, Jr. et al. . | |
| 4,784,828 | 11/1988 | Eckenrod et al. . | |
| 5,049,210 | 9/1991 | Miyasaka et al. . | |
| 5,089,067 | 2/1992 | Schumacher | 148/325 |

OTHER PUBLICATIONS

W. C. Clarke, "Which free-machining chromium stainless", *Metalworking Production,* (Sep. 9, 1964).

John Ronald Blank et al., "Improved and More Consistent Steels for Machining", *International Symopsium on Influence of Metallurgy on Machinability of Steel,* (Sep. 26-28, 1977) Tokyo, Japan.

Charles A. Divine Jr., "What to Consider in Choosing an Alloy", *Metal Progress* (Feb. 1968).

Curtis W. Kovach et al., "How to Upgrade Free-Machining Properties", *Metal Progress,* (Aug. 1967).

Frank M. Richmond, "A Decade of Progress in Machinability, Finishing and Forming", *Metal Progress* (Aug. 1967).

*Primary Examiner*—Deborah Yee

*Attorney, Agent, or Firm*—Dann, Dorfman, Herrelll and Skillman

[57] ABSTRACT

A martensitic stainless steel alloy having a good combination of machinability, hardness capability, and corrosion resistance is disclosed which contains, in weight percent, about:

| | Preferred A | Preferred B | Preferred C |
|---|---|---|---|
| C | up to 0.07 | up to 0.07 | up to 0.07 |
| N | up to 0.07 | up to 0.07 | up to 0.07 |
| C + N | up to 0.08 | up to 0.08 | up to 0.08 |
| Cu | 1.0–3.0 | 1.0–3.5 | 1.0–3.5 |
| delta ferrite | up to 11 | up to 3 | 7–11 |
| Cr | 10.0–14.0 | 10.0–14.0 | 10.0–14.0 |
| S | 0.15–0.55 | 0.15–0.55 | 0.15–0.55 |
| Mn | up to 1.25 | up to 1.25 | up to 1.25 |
| Si | up to 1.0 | up to 1.0 | up to 1.0 |
| P | up to 0.06 | up to 0.06 | up to 0.06 |
| Ni | up to 1.0 | up to 1.0 | up to 1.0 |
| Mo | up to 1.0 | up to 1.0 | up to 1.0 |
| B | up to 0.01 | up to 0.01 | up to 0.01 |
| Te | up to 0.10 | up to 0.10 | up to 0.10 |
| Se | up to 0.25 | up to 0.25 | up to 0.25 |
| Bi | up to 0.15 | up to 0.15 | up to 0.15 |
| Nb | up to 0.10 | up to 0.10 | up to 0.10 |

and the balance is essentially iron. In particular, this alloy has a hardness capability of at least about 32 HRC and good machinability in single-point turning, form-tool turning and drilling at a wide range of hardnesses including between about 96 HRB to 38 HRC.

45 Claims, No Drawings

FREE-MACHINING MARTENSITIC STAINLESS STEEL

FIELD OF THE INVENTION

The present invention relates to an improved martensitic stainless steel alloy and in particular to such an alloy, and an article made therefrom, having a unique combination of machinability, hardness capability, and corrosion resistance.

BACKGROUND OF THE INVENTION

Stainless steels are generally more difficult to machine than carbon and low-alloy steels because of their high strength and high work hardening rate compared to carbon and low-alloy steels. Stainless steels require higher powered machines and a lower machining speed than carbon and low-alloy steels. Further, the high strength and high work hardening rate of stainless steels often shortens the useful tool life during machining. The aforementioned limitations, as well as several precautionary procedures for machining martensitic, ferritic, austenitic, and precipitation hardening stainless steels, are well known and are discussed in the *Metals Handbook Desk Edition*, pp. 15–8, 15–9 (Boyer and Gall ed. 1985).

Some grades of stainless steel have been modified by additions of elements such as sulfur, selenium, phosphorus, or lead to improve their machinability. For example, AISI Type 416, a free-machining, martensitic grade of stainless steel consists essentially of, in weight percent:

| | |
|---|---|
| C | 0.15 max. |
| Mn | 1.25 max. |
| Si | 1.00 max. |
| P | 0.060 max. |
| S | 0.15 min. |
| Cr | 12.00–14.00 |
| Fe | Bal. |

In Type 416 stainless steel, carbon is present to provide the desired strength level; sulfur is present to provide good machinability; and, chromium is present for corrosion resistance.

Attempts have been made to improve the machinability of Type 416 by including manganese or a combination of tellurium, aluminum, and copper. While these elements are known to benefit the machinability of stainless steel, they are also known to detract from such desirable properties such as corrosion resistance and processability, i.e. hot workability and ease of melting, when present in too great amounts. For example, tellurium adversely affects hot workability. Too much manganese adversely affects corrosion resistance. Alloys containing aluminum often require processing by more expensive melting techniques to prevent the formation of aluminum oxide which is detrimental to tool life. Although copper is beneficial to machining in drilling, it has been discovered by the inventor that copper reduces machinability in turning unless carefully balanced with carbon and nitrogen.

Thus, it would be highly desirable to have a stainless steel alloy which has better machinability in both turning and drilling than Type 416 stainless steel and which provides at least the same level of processability, corrosion resistance and hardness capability as Type 416 stainless steel.

SUMMARY OF THE INVENTION

In accordance with the present invention, a martensitic stainless steel alloy is provided which provides better overall machinability than Type 416 stainless steel in combination with hardness capability, corrosion resistance, and processability which are at least as good as Type 416. Overall machinability refers to the combination of machinability in single-point turning and form-tool turning (referred hereinafter generally as "turning" unless otherwise indicated), and drilling. Three preferred compositions of the martensitic, stainless steel alloy of the present invention are as follows, in weight percent:

| | Preferred A | Preferred B | Preferred C |
|---|---|---|---|
| C | up to 0.07 | up to 0.07 | up to 0.07 |
| N | up to 0.07 | up to 0.07 | up to 0.07 |
| C + N | up to 0.08 | up to 0.08 | up to 0.08 |
| Cu | 1.0–3.0 | 1.0–3.5 | 1.0–3.5 |
| delta ferrite | up to 11 | up to 3 | 7–11 |
| Cr | 10.0–14.0 | 10.0–14.0 | 10.0–14.0 |
| S | 0.15–0.55 | 0.15–0.55 | 0.15–0.55 |
| Mn | up to 1.25 | up to 1.25 | up to 1.25 |
| Si | up to 1.0 | up to 1.0 | up to 1.0 |
| P | up to 0.06 | up to 0.06 | up to 0.06 |
| Ni | up to 1.0 | up to 1.0 | up to 1.0 |
| Mo | up to 1.0 | up to 1.0 | up to 1.0 |

The balance of the alloy is essentially iron except for minor amounts of additional elements which do not detract from the desired properties and the usual impurities found in commercial grades of such steels which may vary in amount from a few hundredths of a percent up to larger amounts that do not objectionably detract from the desired combination of properties provided by the alloy. For example, the balance can include up to about 0.05 w/o, preferably up to about 0.02 w/o each of the elements titanium and zirconium; up to about 0.5 w/o, preferably up to about 0.25 w/o cobalt; up to about 0.2 w/o, preferably up to about 0.1 w/o vanadium; up to 0.01 w/o, preferably no more than 0.005 w/o aluminum.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the ranges can be used with one or more of the other ranges for the remaining elements. In addition, a minimum or maximum for an element of one preferred embodiment can be used with the minimum or maximum for that element from another preferred embodiment. Throughout this application, unless otherwise indicated, all compositions in percent will be in percent by weight.

According to the present invention, the elements are balanced to provide an alloy having an improved combination of overall machinability, in particular single-point turning and form-tool turning, hardness capability and corrosion resistance in a substantially-fully martensitic microstructure.

Here and throughout this specification the following definitions apply. Single-point turning is defined as "removing material by forcing a single-point, nonrotating cutting tool against the surface of a rotating workpiece by moving the tool toward and/or along the axis of rotation of the workpiece." Form-tool turning is defined as "removing material by forcing a single-edge, nonrotating cutting tool, circular or flat, against the surface of a rotating workpiece by moving the tool transverse to the axis of rotation of the workpiece to produce an inverse or reverse form of the form tool upon the workpiece." Hardness capability is defined as "the hardness obtainable from a tempering temperature of 900 F. (482 C.)." A martensitic stainless steel usually obtains peak hardness after tempering at about 900 F. (482 C.).

DETAILED DESCRIPTION OF A PREFERRED EMBODIMENT OF THE INVENTION

According to the present invention, carbon and nitrogen are present in this alloy to benefit the hardness capability. A hardness capability of at least about 32 HRC as measured in accordance with ASTM specification A582 is desired for many applications of this alloy. Carbon and nitrogen also inhibit the formation of delta-ferrite in this alloy. Therefore, up to about 0.07 w/o, better yet up to about 0.05 w/o, each of carbon and nitrogen can be present in this alloy. Both carbon and nitrogen adversely affect the alloy's machinability in turning. Therefore, the combined concentration of carbon and nitrogen in the alloy, as well as the individual concentrations of carbon and nitrogen, must be limited. Up to about 0.08 w/o, better yet up to about 0.06 w/o carbon-plus-nitrogen is present in this alloy. Preferably, this alloy contains up to about 0.03 w/o each of carbon and nitrogen, and contains a combined concentration of up to about 0.04 w/o carbon-plus-nitrogen.

Copper contributes to the good hardness capability of this alloy and benefits the alloy's machinability in drilling. Therefore, at least about 1.0 w/o, better yet at least about 2.0 w/o copper is present in this alloy. Although too much copper is detrimental to this alloy's machinability in turning, it is less detrimental than carbon and nitrogen. Thus, to provide both the desired hardness capability and improved machinability in turning, copper can be substituted for some or all of the carbon and nitrogen that may be present in this alloy. In this regard, the present alloy can have a significantly reduced amount of carbon-plus-nitrogen compared to AISI Type 416 and still provide the desired hardness capability. Too much copper is also detrimental to the alloy's hot workability. Accordingly, copper is restricted to not more than about 3.5 w/o, better yet not more than about 3.0 w/o. Preferably, this alloy contains about 2.2 to 2.7 w/o copper.

Sulfur is present in this alloy because of its beneficial effect on overall machinability. Therefore, at least about 0.15 w/o, better yet at least about 0.20 w/o sulfur is present. Too much sulfur, however, adversely affects this alloy's workability, corrosion resistance, and mechanical properties such as ductility. For that reason, not more than about 0.55 w/o, better yet not more than about 0.50 w/o sulfur is present in this alloy preferably, this alloy contains about 0.25–0.45 w/o sulfur.

Chromium contributes to the good corrosion resistance of this alloy and therefore at least about 10.0% chromium is present in this alloy. Chromium is a ferrite former and promotes the formation of delta-ferrite. In order to limit the amount of delta ferrite present in this alloy, chromium is restricted to not more than about 14.0 w/o and better yet to not more than about 13.0. Preferably, this alloy contains about 10.0–12.0 w/o chromium.

Manganese can be present in this alloy for its beneficial effect on overall machinability. Manganese, however, combines with sulfur to form manganese sulfides which adversely affect this alloy's corrosion resistance. Therefore, when less-than-optimal corrosion resistance is acceptable, up to about 1.25 w/o, better yet up to about 0.75 w/o, and preferably up to about 0.5 w/o manganese can be present in this alloy.

Additional elements may be present in controlled amounts to benefit other desirable properties provided by this alloy. For example, up to about 1.0 w/o nickel can be present in this alloy to benefit the alloy's toughness. Nickel, however, is preferably limited to not more than about 0.75 w/o, and better yet to not more than about 0.5 w/o, because too much nickel increases this alloy's temper resistance and lowers the critical temperature ($A_{cl}$) both of which limit the alloy's ability to be annealed to low hardness levels for optimum machinability. Up to about 1.0 w/o molybdenum can be present in this alloy to benefit corrosion resistance particularly in chloride containing environments. Molybdenum is preferably limited to not more than about 0.75 w/o, and better yet to not more than about 0.5 w/o, because it promotes the formation of delta-ferrite.

Up to about 0.10 w/o, preferably up to about 0.05 w/o tellurium; up to about 0.25 w/o, preferably up to about 0.10 w/o selenium; and, up to about 0.15 w/o, preferably up to about 0.10 w/o bismuth can be present to further benefit this alloy's overall machinability.

Up to about 0.01 w/o, preferably up to about 0.005 w/o boron can be present to benefit this alloy's hot workability. Up to about 1.0 w/o, preferably up to about 0.75 w/o silicon can be present as a residual from deoxidizing additions.

While up to about 0.10 w/o niobium can be present to benefit this alloy's toughness, too much niobium increases the alloy's temper resistance thereby adversely affecting machinability. Therefore, when present, columbium is preferably limited to not more than about 0.05 w/o. Up to about 0.06 w/o, better yet up to about 0.05, and preferably up to about 0.04 w/o phosphorus can be added to improve the quality of the alloy's machined surface finish.

Within their respective weight percent limits, the austenite-forming elements, nickel, nitrogen, carbon, manganese, and copper, and the ferrite-forming elements, chromium, molybdenum, and silicon are balanced to limit the presence of delta-ferrite when the alloy is in the wrought condition. Up to about 11% by volume delta-ferrite can be present in the alloy in the wrought condition if the alloy is to be machined by drilling or single-point turning. If, however, the alloy is to be machined by form-tool turning, for example, in a screw machine, delta-ferrite is restricted to very low levels, i.e., not more than about 4 volume percent, better yet not more than about 3 volume percent in the wrought condition. For best results regardless of the type of machining, the elements are balanced such that this alloy is substantially free of delta-ferrite in the wrought condition.

Within their respective weight percent ranges, copper and carbon-plus-nitrogen are balanced to provide both the desired overall machinability and the desired hardness capability. There is an inverse relationship between copper and carbon-plus-nitrogen with respect to hardness in this alloy. Thus, when the alloy contains a very low amount of carbon-plus-nitrogen, e.g., less than about 0.01 w/o, the concentration of copper is at or near the upper weight percent limit for copper. Conversely, when the alloy contains carbon-plus-nitrogen at or near the upper weight percent limit for carbon-plus-nitrogen, the concentration of copper is at or near the lower weight percent limit for copper.

EXAMPLES

Set forth in Table I are the weight percent compositions of Examples 1–8 of the alloy according to this invention and comparative heats A–H.

TABLE I

| Ex./Ht. No. | C | Mn | Si | P | S | Cr | Ni | Mo | Cu | N | C + N | Fe |
|---|---|---|---|---|---|---|---|---|---|---|---|---|
| 1 | .030 | .42 | .59 | .014 | .36 | 11.86 | .24 | .05 | 1.03 | .025 | .055 | Bal. |
| 2 | .049 | .46 | .62 | .014 | .36 | 13.23 | .23 | .05 | 2.27 | .031 | .080 | " |
| 3 | .043 | .43 | .62 | .015 | .36 | 13.10 | .23 | .06 | 3.10 | .020 | .063 | " |
| 4 | .060 | .42 | .62 | .018 | .35 | 13.94 | .24 | .06 | 3.10 | .022 | .082 | " |
| 5 | .027 | .41 | .60 | .015 | .33 | 13.14 | .25 | .05 | 3.00 | .026 | .053 | " |
| 6 | .027 | .41 | .58 | .017 | .34 | 11.75 | .25 | .05 | 3.00 | .026 | .053 | " |
| 7 | .024 | .44 | .50 | .029 | .31 | 11.61 | .25 | .05 | 2.97 | .031 | .055 | " |
| 8 | .018 | .43 | .48 | .028 | .33 | 11.15 | .25 | .05 | 2.46 | .019 | .037 | " |
| A | .090 | .41 | .60 | .015 | .30 | 13.20 | .25 | .06 | .05 | .026 | .116 | " |
| B | .081 | .47 | .61 | .013 | .36 | 13.31 | .24 | .05 | .06 | .038 | .119 | " |
| C | .066 | .44 | .61 | .016 | .34 | 13.68 | .22 | .06 | 2.27 | .026 | .092 | " |
| D | .066 | .48 | .64 | .015 | .34 | 13.81 | .24 | .05 | 2.28 | .034 | .100 | " |
| E | .087 | .43 | .62 | .016 | .34 | 14.30 | .22 | .06 | 2.26 | .026 | .113 | " |
| F | .059 | .47 | .65 | .015 | .35 | 13.93 | .23 | .05 | 3.05 | .036 | .095 | " |
| G | .088 | .42 | .60 | .016 | .35 | 14.77 | .23 | .06 | 3.07 | .030 | .118 | " |
| H | .085 | .40 | .59 | .015 | .35 | 13.12 | .25 | .05 | .06 | .028 | .113 | " |

Like AISI type 416 stainless steel, the present alloy can be heat treated to a variety of desired hardnesses, such as 96–98 HRB, 26–32 HRC, or 31–38 HRC. When improved machinability in turning compared to Type 416 stainless steel is desired in the annealed condition, typically at a hardness level of about 96–98 HRB, the concentrations of copper and carbon-plus-nitrogen can be within the broadest ranges for those constituents as described above. However, where improved machinability in turning at a higher hardness compared to Type 416 stainless steel is desired, for example at a hardness of about 26–32 HRC or higher, the concentrations of copper and carbon-plus-nitrogen are restricted to the preferred ranges for those elements as described above. Thus, in addition to controlling the volume percent delta ferrite, the weight percents of copper and carbon-plus-nitrogen are controlled within their respective ranges to provide the desired machinability at a selected hardness level.

No special techniques are required in melting, casting, or working the alloy of the present invention. Arc melting followed by argon-oxygen decarburization is the preferred method of melting and refining, but other practices can be used. This alloy can be made by powder metallurgy techniques if desired.

The alloy according to the present invention is hot worked from a furnace temperature of about 2000–2300 F. (1093–1260 C.), preferably 2150–2250 F. (1176–1232 C.), with reheating as necessary after intermediate reductions. The alloy is hardened by austenitizing at about 1800–1900 F. (982–1038 C.), quenching, preferably in oil, and then tempering or annealing for about 2–8 hours, preferably about 4 hours, at a furnace temperature of about 850–1450 F. (454–788 C.), and then air cooling from the tempering or annealing temperature.

The alloy of the present invention can be formed into a variety of shapes for a wide variety of uses and lends itself to the formation of billets, bars, rod, wire, strip, plate, or sheet using conventional practices. The preferred practice is to hot work the ingot to billet form followed by hot rolling the billet to bar, wire, or strip. This alloy can also be formed by an upset process, such as by cold or warm heading, into fasteners, such as bolts, nuts and the like.

The composition of heats A, B, and H are representative of Type 416 stainless steel and are outside the composition of the present invention. Heats C, D, E, F and G are also outside the composition of the present invention.

EXAMPLE I

Examples 1–4 and comparative heats A–G were induction melted under argon and cast as 3¼ in (8.26 cm) square ingots. Each of the Examples and comparative heats was forged to 1¾ in (4.45 cm) square bar from a hot working temperature of 2150 F. (1177 C.), reheated to 2150 F. (1177 C.), forged to 1 13/16 in (3.01 cm ) square bars, and then cooled in air.

To determine the volume percent ferrite, longitudinal metallographic samples were cut from a portion of each of the 1 3/16 in (3.01 cm ) square bars. The metallographic samples were austenitized at 1825 F. (996 C.) for one hour and quenched in oil at room temperature. The v/o delta-ferrite in each microstructure sample was then measured by the point counting method.

To determine the maximum hardness capability of the Examples and the comparative heats, cross-sectional, hardness-capability samples were cut from each of the 1 3/16 in (3.01 cm ) square bars. The hardness-capability samples were austenitized at 1825 F. (997 C.) for one hour, quenched in oil at room temperature, tempered at 900 F. (482 C.) for 4 hours, and then air cooled. The hardness of each sample was then tested on the Rockwell C scale.

AISI Type 416 alloy is often sold in the annealed condition at a hardness of about 97–98 HRB. In order to compare the machinability of the present alloy to the commercially available form of the Type 416 alloy, longitudinal machinability samples were cut from each 1 3/16 in (3.01 cm ) square bar and heat treated, as discussed below, to attain a hardness of about 97 to 98 HRB. Each machinability sample was austenitized at 1825 F. (997 C.) for one hour, oil quenched, annealed at a final annealing temperature between 1150 and 1325 F. (621–719 C.) for 4 hours, and then air cooled. The final annealing temperature for each sample was determined by selecting an initial reference temperature estimated to produce the desired hardness of 97–98 HRB and then varying the initial reference temperature by 25° to 50°

F. (12°–24° C.) using separate samples until the desired hardness was achieved.

Drilling sample bars 6in (15.2 cm ) long were cut from each 1 3/16 in (3.01 cm ) square bar. The drilling sample bars were austenitized at 1825 F. (996 C.) for 1 hour, quenched in oil at room temperature, annealed at the final annealing temperature (as described above) for 4 hours, and then air cooled. The heat treated bars were turned to 1 in (2.54 cm ) round and then were machine ground and finished to form approximately ½ in (1.27 cm ) wide parallel flat surfaces thereon. The bars then underwent drill penetration testing to measure the average depth of penetration, in thousandths of an inch, under controlled conditions. Drill penetration values were obtained for each sample bar by measuring the average depth of penetration into the samples by ¼ in (0.64 cm ) diameter drills in a time interval of 15 seconds with the drill rotating at or very close to 670 rpm under a constant load. The constant load was provided by bringing the drill bit against the surface of the specimen and applying a constant force of 100 pounds (45 Kg) to the drill.

To determine machinability of the alloy in turning at a hardness level of 97–98 HRB, turning sample bars 10 in (25.4 cm ) long were cut from each of the 1 3/16 in (3.01 cm ) square bars. The turning sample bars were austenitized at 1825 F. (996 C.) for 1 hour, quenched in oil at room temperature, annealed at the final annealing temperature (as described above) for 4 hours, and then air cooled. Each turning sample bar was annealed to achieve a hardness of about 96.5 to 98 HRB. The heat treated bars were turned to 0.988 in (2.510 cm ) round. Turning machinability was evaluated by conducting the lathe tool life test using single point, unlubricated high speed steel tooling with the lathe operating under the following conditions: 275 SFPM (84 SMPM) cutting speed, 0.0085 in/rev (0.22 cm/rev) feed, and 0.0625 in (0.159 cm ) depth of cut. Tool life values are determined by measuring the distance traveled by the cutting tool along the length of the test sample before the tool significantly wears or fails.

Set forth in Table II are the results of the metallographic, hardness, and machinability testing as just described, including the volume percent of delta-ferrite (v/o δ), the hardness capability as measured on the Rockwell C hardness scale (HRC Hardness Capability), the machinability in drilling (Avg. Drill Depth (in)), and the machinability in single-point turning (Avg. Tool Life (in.)), for Examples 1–4 and comparative heats A–G. Also shown in Table II for convenient reference are the weight percents of Cr, Cu, C, N, and C+N for each of the tested examples and comparative heats.

TABLE II

| | | | | | | | | Machinability[1] | |
|---|---|---|---|---|---|---|---|---|---|
| Ex/Ht | Cr | Cu | C | N | C + N | v/oδ | HRC Hardness Capability | Avg. Drill Depth (in)/(cm) | Avg. Tool Life (in)/(cm) |
| 1 | 11.86 | 1.03 | 0.030 | 0.025 | 0.055 | 6.7 | 34 | 0.28/0.71 | 6.2[2]/15.7 |
| 2 | 13.23 | 2.27 | 0.049 | 0.031 | 0.080 | 7.6 | 40 | 0.29/0.74 | 3.4/8.6 |
| 3 | 13.10 | 3.10 | 0.043 | 0.020 | 0.063 | 9.2 | 39½ | 0.34/0.86 | 3.8/9.7 |
| 4 | 13.94 | 3.10 | 0.060 | 0.022 | 0.082 | 10.9 | 41½ | 0.33/0.84 | 2.8/7.1 |
| A | 13.20 | 0.05 | 0.090 | 0.026 | 0.116 | 13.4 | 38½ | 0.29/0.74 | 2.2/5.6 |
| B | 13.31 | 0.06 | 0.081 | 0.038 | 0.119 | 12.5 | 39 | 0.27/0.69 | 2.2/5.6 |
| C | 13.68 | 2.27 | 0.066 | 0.026 | 0.092 | 12.3 | 41 | 0.32/0.81 | 2.1/5.3 |
| D | 13.81 | 2.28 | 0.066 | 0.034 | 0.100 | 9.3 | 41½ | 0.27/0.69 | 1.8/4.6 |
| E | 14.30 | 2.26 | 0.087 | 0.026 | 0.113 | 11.5 | 43 | 0.31/0.79 | 1.9/4.8 |
| F | 13.93 | 3.05 | 0.059 | 0.036 | 0.095 | 9.0 | 41½ | 0.31/0.79 | 2.1/5.3 |
| G | 14.77 | 3.07 | 0.088 | 0.030 | 0.118 | 13.3 | 43½ | 0.33/0.84 | 1.7/4.3 |

[1]At 97–98 HRB
[2]Tool did not fail over length of test specimen.

The data in Table II demonstrates that at the same hardness levels, Examples 1–4, representing the alloy according to the present invention, have machinability in single-point turning superior to Heats A and B, representing Type 416 stainless steel. The data in Table II further demonstrates that Examples 1–4 each has a hardness capability of at least 32 HRC, the minimum desired hardness, and machinability in drilling that is at least as good as Heats A and B.

It is significant to note from Table II that Example 2 and Heats C, D, and E each have similar concentrations of copper but different combined concentrations of carbon-plus-nitrogen. Example 2, having the lowest concentration of carbon-plus-nitrogen of those four samples, has significantly better machinability in single-point turning than Heats C, D, or E. Similarly, Examples 3 and 4 and heats F and G each have similar amounts of copper but different concentrations of carbon-plus-nitrogen. Examples 3 and 4, having lower concentrations of carbon-plus-nitrogen than Heat F or G, have significantly better machinability in single-point turning than heats F and G. Further, Example 3, which has a lower concentration of carbon-plus-nitrogen than Example 4, has better machinability in single-point turning than Example 4. Thus, the data in Table II further demonstrates the importance of controlling the combined concentration of carbon and nitrogen (%C+%N) to obtain the good machinability in single-point turning that is characteristic of the present alloy.

Example II

Examples 5 and 6 and comparative Heat H, were induction melted under argon and cast as 7½ in (19.1 cm ) square ingots. The ingots were forged to 3⅛ in (7.9 cm ) square billets from a forging temperature of 2150–2250 F. (1177–1232 C.), annealed at 1435 F. (780 C.), furnace cooled, and then machine ground. The billets were then heated to 2250 F. (1232 C.), hot rolled to 1.093 in (2.776 cm ) round bar, annealed at 1435 F. (780 C.), and then furnace cooled. The 1.093 in (2.776 cm ) round bars were then austenitized at 1832 F. (1000 C.) for 1 hour, quenched in oil at room temperature, annealed for 4 hours at a temperature selected to result in a hardness of 98–99 HRB, and then air cooled. The annealed bars were then machined to 1 in (2.54 cm ) round by turning and centerless grinding.

The volume percent delta-ferrite, v/o δ, was determined using the point counting method on longitudinal samples taken from the 1 in (2.54 cm ) round bars. The hardness capability of each bar was also determined using the same procedure as set forth in Example I.

To determine the machinability of this alloy in form-tool turning, as measured by the average number of parts machined before significant tool wear or tool failure, screw machine tests were conducted on the 1 in (2.54 cm ) round bars per ASTM E618 with the screw machine operating as follows: 329 SFPM, rough form tool feed of 0.0020 in/rev (0.0051 cm /rev) and finish form tool feed 0.0008 in/rev (0.0020 cm /rev), using a water emulsified cutting fluid (5% solution) in both the rough and finish cuts.

To determine machinability in drilling, average drill penetration tests were performed on test samples of Example 6 and Heat H using the same procedure as described above in Example I.

Set forth in Table III are the results of the metallographic, hardness, and machinability testing including the volume percent of delta-ferrite (v/o δ), the hardness capability as measured on the Rockwell C hardness scale (HRC Hardness Capability), the machinability in form-tool turning in the screw machine test as measured by the average number of parts machined before significant tool wear or tool failure (Avg. No. Parts), and the machinability in drilling as measured by the average drill penetration in inches (Avg. Drill Depth (in)). Also shown in Table III for ease of reference are the weight percents for Cr, Cu, C, N, and C+N for each of the tested samples.

TABLE III

| | | | | | | | | Machinability[1] | |
|---|---|---|---|---|---|---|---|---|---|
| Ex/Ht | Cr | Cu | C | N | C + N | v/oδ | HRC Hardness Capability | Avg. No. Parts | Avg. Drill Depth (in)/(cm) |
| H | 13.12 | 0.06 | 0.085 | 0.028 | 0.113 | 7 | 40 | 186 | 0.32/0.81 |
| 5 | 13.14 | 3.00 | 0.027 | 0.026 | 0.053 | 8 | 39½ | 191 | N.D.[2] |
| 6 | 11.75 | 3.00 | 0.027 | 0.026 | 0.053 | 0 | 40 | 378 | 0.38/0.97 |

[1]At 98–99 HRB
[2]Not determined because of results of screw machine test.

The data in Table III shows that Example 6 of the present alloy, which has zero volume percent delta-ferrite, has machinability in form-tool turning and machinability in drilling superior to Heat H, representing Type 416 stainless steel. On the other hand, Example 5, containing 8 v/o delta ferrite has machinability in form-tool turning that is the same as Heat H, but would be expected to have superior drilling machinability in view of the data in Table II. Thus, the data demonstrates the need to limit delta ferrite content to obtain the improved machinability in form tool turning compared to Type 416 stainless steel. It is also significant to note from Table III that Examples 5 and 6 have hardness capability of at least 32 HRC, the minimum desired hardness.

EXAMPLE III

Examples 7 and 8 were induction melted under argon and cast as 3¼ in (8.23 cm ) square ingots. The ingots were forged to 1¼ in (3.18 cm ) square bars from a forging temperature of 2150 F. (1177 C.) with a reheat at 1¾ in, air cooled, austenitized at 1830 F. (999 C.) for 1 hour, and then quenched in oil at room temperature. The hardness capability of Examples 7 and 8 was determined in the manner described in Examples I and II. The ferrite content was confirmed by light microscopy. The 1¼ in (3.18 cm ) square bars from Example 8 were then tempered at 975 F. (524 C.), and those from example 7 at 1000 F. (538 C.), for 4 hours and air cooled to attain a hardness of 29–30 HRC. The tempered bars were then turned to 1 in (2.54 cm ) round as 11½ in (29.2 cm ) long turning samples. The turning samples were tested by conducting the lathe tool life test using single point, unlubricated, high-speed steel tooling with the lathe operating at 250 SFPM (76 SMPM) cutting speed, 0.0066 in/rev (0.0168 cm /rev) feed, and 0.0625 in (0.159 cm ) depth of cut.

Set forth in Table IV are results of the metallographic, hardness, and machinability testing including the volume percent ferrite (v/o δ), the hardness capability as measured on the Rockwell C hardness scale (Hardness Capability HRC), and the machinability in single-point turning as determined in the average tool life test in inches, "Avg. Tool Life (in)," for Examples 7 and 8. Also shown in Table IV are the weight percents of Cr, Cu, C, N, and C+N for each test sample.

TABLE IV

| Ex/Ht | Cr | Cu | C | N | C + N | v/oδ | Hardness Capability HRC | Machinability[1] Avg. Tool Life (in/(cm) |
|---|---|---|---|---|---|---|---|---|
| 7 | 11.61 | 2.97 | 0.024 | 0.031 | 0.055 | 0 | 39½ | 2.8/7.1 |
| 8 | 11.15 | 2.46 | 0.018 | 0.019 | 0.037 | 0 | 37 | 4.2/10.7 |

[1]At 29–30 HRC

The data in Table IV demonstrates that at a hardness level of 29–30 HRC, Example 8, having copper and carbon-plus-nitrogen plus-nitrogen concentrations within the preferred ranges of the present alloy, has better machinability than Example 7. In addition, Example 8 has significantly better machinability than Type 416 stainless steel which, at the same hardness level, would be expected to have an average tool life of about 2.4 in (6.1 cm ) in this test.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A martensitic, stainless steel alloy having a good combination of machinability, hardness capability, and corrosion resistance consisting essentially of, in weight percent,

| | |
|---|---|
| Carbon | Up to 0.07 |
| Nitrogen | Up to 0.07 |
| Carbon + Nitrogen | Up to 0.08 |
| Copper | 1.0–3.0 |
| Chromium | 10.0–14.0 |
| Sulfur | 0.15–0.55 |
| Manganese | Up to 1.25 |
| Silicon | Up to 1.0 |
| Phosphorus | Up to 0.06 |
| Nickel | Up to 1.0 |

-continued

| | |
|---|---|
| Molybdenum | Up to 1.0 |
| Boron | Up to 0.01 |
| Tellurium | Up to 0.10 |
| Selenium | Up to 0.25 |
| Bismuth | Up to 0.15 |
| Niobium | Up to 0.10 |

the balance essentially iron, wherein said elements are balanced such that in the wrought condition, said alloy contains up to about 11 volume percent delta ferrite.

2. An alloy as recited in claim 1 which contains up to about 0.06 w/o carbon-plus-nitrogen.

3. An alloy as recited in claim 1 which contains up to about 0.05 w/o each of carbon and nitrogen.

4. An alloy as recited in claim 1 which contains about 2.0–3.0 w/o copper.

5. An alloy as recited in claim 1 which contains about 2.2 to 2.7 w/o copper.

6. An alloy as recited in claim 1 wherein said elements are balanced such that in the wrought condition, said alloy contains up to about 4 volume percent delta ferrite.

7. An alloy as recited in claim 6 which contains up to about 0.06 w/o carbon-plus-nitrogen.

8. An alloy as recited in claim 6 which contains up to about 0.05 w/o each of carbon and nitrogen.

9. An alloy as recited in claim 6 which contains about 2.0–3.0 w/o copper.

10. An alloy as recited in claim 1 wherein said elements are balanced such that in the annealed condition, said alloy is substantially free of delta ferrite.

11. An alloy as recited in claim 10 which contains up to about 0.06 w/o carbon-plus-nitrogen.

12. An alloy as recited in claim 10 which contains up to about 0.05 w/o each of carbon and nitrogen.

13. An alloy as recited in claim 10 which contains about 2.0–3.0 w/o copper.

14. A martensitic, stainless steel alloy having a good combination of machinability, hardness capability, and corrosion resistance, consisting essentially of, in weight percent,

| | |
|---|---|
| Carbon | Up to 0.05 |
| Nitrogen | Up to 0.05 |
| Carbon + Nitrogen | Up to 0.06 |
| Copper | 2.0–3.0 |
| Chromium | 10.0–13.0 |
| Sulfur | 0.20–0.50 |
| Manganese | Up to 0.75 |
| Silicon | Up to 1.0 |
| Phosphorus | Up to 0.05 |
| Nickel | Up to 0.75 |
| Molybdenum | Up to 0.75 |
| Boron | Up to 0.005 |
| Tellurium | Up to 0.05 |
| Selenium | Up to 0.10 |
| Bismuth | Up to 0.10 |
| Niobium | Up to 0.05 |

the balance essentially iron, wherein said elements are balanced such that in the wrought condition, said alloy contains up to about 4 volume percent delta ferrite.

15. The alloy as recited in claim 14 which contains up to about 0.04 w/o carbon-plus-nitrogen.

16. The alloy as recited in claim 14 which contains up to about 0.03 w/o each of carbon and nitrogen.

17. The alloy as recited in claim 14 which contains about 2.2–2.7 w/o copper.

18. The alloy as recited in claim 14 wherein said elements are balanced such that in the wrought condition, said alloy is substantially free of delta ferrite.

19. The alloy as recited in claim 18 which contains up to about 0.04 w/o carbon-plus-nitrogen.

20. The alloy as recited in claim 18 which contains up to about 0.03 w/o each of carbon and nitrogen.

21. The alloy as recited in claim 18 which contains about 2.2–2.7 w/o copper.

22. A martensitic, stainless steel alloy having a good combination of machinability, hardness capability, and corrosion resistance consisting essentially of, in weight percent,

| | |
|---|---|
| Carbon | Up to 0.07 |
| Nitrogen | Up to 0.07 |
| Carbon + Nitrogen | Up to 0.08 |
| Copper | 1.0–3.5 |
| Chromium | 10.0–14.0 |
| Sulfur | 0.15–0.55 |
| Manganese | Up to 1.25 |
| Silicon | Up to 1.0 |
| Phosphorus | Up to 0.06 |
| Nickel | Up to 1.0 |
| Molybdenum | Up to 1.0 |
| Boron | Up to 0.01 |
| Tellurium | Up to 0.10 |
| Selenium | Up to 0.25 |
| Bismuth | Up to 0.15 |
| Niobium | Up to 0.10 |

the balance essentially iron, wherein said elements are balanced such that in the wrought condition, said alloy contains up to about 3 volume percent delta ferrite.

23. An alloy as recited in claim 22 which contains up to about 0.06 w/o carbon-plus-nitrogen.

24. An alloy as recited in claim 22 which contains up to about 0.05 w/o each of carbon and nitrogen.

25. An alloy as recited in claim 22 which contains about 2.0–3.0 w/o copper.

26. An alloy as recited in claim 22 which contains about 2.2 to 2.7 w/o copper.

27. A martensitic, stainless steel alloy having a good combination of machinability, hardness capability, and corrosion resistance, consisting essentially of, in weight percent,

| | |
|---|---|
| Carbon | Up to 0.07 |
| Nitrogen | Up to 0.07 |
| Carbon + Nitrogen | Up to 0.08 |
| Copper | 1.0–3.5 |
| Chromium | 10.0–14.0 |
| Sulfur | 0.15–0.55 |
| Manganese | Up to 1.25 |
| Silicon | Up to 1.0 |
| Phosphorus | Up to 0.06 |
| Nickel | Up to 1.0 |
| Molybdenum | Up to 1.0 |
| Boron | Up to 0.01 |
| Tellurium | Up to 0.10 |
| Selenium | Up to 0.25 |
| Bismuth | Up to 0.15 |
| Niobium | Up to 0.10 |

the balance essentially iron, wherein said elements are balanced such that in the wrought condition, said alloy is substantially free of delta ferrite.

28. The alloy as recited in claim 27 which contains up to about 0.06 w/o carbon-plus-nitrogen.

29. The alloy as recited in claim 27 which contains up to about 0.04 w/o each of carbon and nitrogen.

30. The alloy as recited in claim 27 which contains about 2.0–3.0 w/o copper.

31. The alloy as recited in claim 27 which contains about 2.2–2.7 w/o copper.

32. A martensitic, stainless steel alloy having a good combination of machinability, hardness capability, and corrosion resistance consisting essentially of, in weight percent,

| | |
|---|---|
| Carbon | Up to 0.07 |
| Nitrogen | Up to 0.07 |
| Carbon + Nitrogen | Up to 0.08 |
| Copper | 1.0–3.5 |
| Chromium | 10.0–14.0 |
| Sulfur | 0.15–0.55 |
| Manganese | Up to 1.25 |
| Silicon | Up to 1.0 |
| Phosphorus | Up to 0.06 |
| Nickel | Up to 1.0 |
| Molybdenum | Up to 1.0 |
| Boron | Up to 0.01 |
| Tellurium | Up to 0.10 |
| Selenium | Up to 0.25 |
| Bismuth | Up to 0.15 |
| Niobium | Up to 0.10 |

the balance essentially iron, wherein said elements are balanced such that in the wrought condition, said alloy contains about 7–11 volume percent delta ferrite.

33. An alloy as recited in claim 32 which contains up to about 0.06 w/o carbon-plus-nitrogen.

34. An alloy as recited in claim 32 which contains up to about 0.05 w/o each of carbon and nitrogen.

35. An alloy as recited in claim 32 which contains about 2.0–3.0 w/o copper.

36. An alloy as recited in claim 32 which contains about 2.2 to 2.7 w/o copper.

37. A martensitic, stainless steel alloy having a good combination of machinability, hardness capability, and corrosion resistance, consisting essentially of, in weight percent,

| | |
|---|---|
| Carbon | Up to 0.05 |
| Nitrogen | Up to 0.05 |
| Carbon + Nitrogen | Up to 0.06 |
| Copper | 2.0–3.0 |
| Chromium | 10.0–13.0 |
| Sulfur | 0.20–0.50 |
| Manganese | Up to 0.75 |
| Silicon | Up to 1.0 |
| Phosphorus | Up to 0.05 |
| Nickel | Up to 0.75 |
| Molybdenum | Up to 0.75 |
| Boron | Up to 0.005 |
| Tellurium | Up to 0.05 |
| Selenium | Up to 0.10 |
| Bismuth | Up to 0.10 |
| Niobium | Up to 0.05 |

the balance essentially iron, wherein said elements are balanced such that in the wrought condition, said alloy contains about 7 to 11 volume percent delta ferrite.

38. The alloy as recited in claim 37 which contains up to about 0.04 w/o carbon-plus-nitrogen.

39. The alloy as recited in claim 37 which contains up to about 0.03 w/o each of carbon and nitrogen.

40. The alloy as recited in claim 37 which contains about 2.2–2.7 w/o copper.

41. A martensitic, stainless steel alloy having a good combination of machinability, hardness capability, and corrosion resistance, consisting essentially of, in weight percent,

| | |
|---|---|
| Carbon | Up to 0.03 |
| Nitrogen | Up to 0.03 |
| Carbon + Nitrogen | Up to 0.04 |
| Copper | 2.2–2.7 |
| Chromium | 10.0–12.0 |
| Sulfur | 0.15–0.45 |
| Manganese | Up to 1.25 |
| Silicon | Up to 0.75 |
| Phosphorus | Up to 0.04 |
| Nickel | Up to 0.5 |
| Molybdenum | Up to 0.5 |

the balance essentially iron, wherein said elements are balanced such that in the wrought condition said alloy contains up to about 3 volume percent delta ferrite.

42. The alloy as recited in claim 41 which contains about 0.20–0.45 w/o sulfur.

43. The alloy as recited in claim 41 which contains up to about 0.75 w/o manganese.

44. A martensitic, stainless steel alloy having a good combination of machinability, hardness capability, and corrosion resistance, consisting essentially of, in weight percent,

| | |
|---|---|
| Carbon | Up to 0.03 |
| Nitrogen | Up to 0.03 |
| Carbon + Nitrogen | Up to 0.04 |
| Copper | 2.2–2.7 |
| Chromium | 10.0–12.0 |
| Sulfur | 0.25–0.45 |
| Manganese | Up to 0.5 |
| Silicon | Up to 0.75 |
| Phosphorus | Up to 0.04 |
| Nickel | Up to 0.5 |
| Molybdenum | Up to 0.5 |

the balance essentially iron, wherein said elements are balanced such that in the wrought condition said alloy is substantially free of delta ferrite.

45. A martensitic, stainless steel alloy having a good combination of machinability, hardness capability, and corrosion resistance, consisting essentially of, in weight percent,

| | |
|---|---|
| Carbon | Up to 0.03 |
| Nitrogen | Up to 0.03 |
| Carbon + Nitrogen | Up to 0.04 |
| Copper | 2.2–2.7 |
| Chromium | 10.0–12.0 |
| Sulfur | 0.25–0.45 |
| Manganese | Up to 0.5 |
| Silicon | Up to 0.75 |
| Phosphorus | Up to 0.04 |
| Nickel | Up to 0.5 |
| Molybdenum | Up to 0.5 |

the balance essentially iron, wherein said elements are balanced such that in the wrought condition said alloy contains about 7–11 volume percent delta ferrite.

* * * * *